US008572912B2

(12) United States Patent
Neuhofer, Jr.

(10) Patent No.: US 8,572,912 B2
(45) Date of Patent: Nov. 5, 2013

(54) COVER PROFILE FOR FLOORS

(76) Inventor: Franz Neuhofer, Jr., Zell am Moos (AT)

( * ) Notice: Subject to any disclaimer, the term of this patent is extended or adjusted under 35 U.S.C. 154(b) by 337 days.

(21) Appl. No.: 12/737,637

(22) PCT Filed: Aug. 6, 2009

(86) PCT No.: PCT/AT2009/000303
§ 371 (c)(1),
(2), (4) Date: Feb. 1, 2011

(87) PCT Pub. No.: WO2010/019974
PCT Pub. Date: Feb. 25, 2010

(65) Prior Publication Data

US 2011/0131919 A1 Jun. 9, 2011

(30) Foreign Application Priority Data

Aug. 22, 2008 (AT) ..... A 1301/2008

(51) Int. Cl.
*E04D 5/00* (2006.01)
*E04B 5/00* (2006.01)

(52) U.S. Cl.
CPC ..... *E04B 5/00* (2013.01)
USPC ..... 52/211; 52/287.1; 52/395; 52/466; 52/468; 52/718.04

(58) Field of Classification Search
USPC ..... 52/177, 211, 287.1, 393–395, 396.04, 52/396.1, 402, 459, 464, 466, 468, 716.1, 52/718.01, 718.02, 718.04–718.06; 49/467; 16/15
See application file for complete search history.

(56) References Cited

U.S. PATENT DOCUMENTS

| | | | | |
|---|---|---|---|---|
| 3,671,369 | A * | 6/1972 | Kvalheim et al. | 52/716.1 |
| 4,067,155 | A * | 1/1978 | Ruff et al. | 52/287.1 |
| 5,657,598 | A | 8/1997 | Wilbs et al. | |
| 6,615,557 | B2 * | 9/2003 | Smythe, Jr. | 52/287.1 |
| 7,429,069 | B2 | 9/2008 | Kellinghaus | |

(Continued)

FOREIGN PATENT DOCUMENTS

| | | |
|---|---|---|
| DE | 10 2005 056 439 | 5/2007 |
| EP | 0 711 886 | 5/1996 |

(Continued)

OTHER PUBLICATIONS

International Search Report.

*Primary Examiner* — Mark Wendell
*Assistant Examiner* — Matthew J Smith
(74) *Attorney, Agent, or Firm* — Collard & Roe, P.C.

(57) ABSTRACT

A cover profile (1) for floors for adaptation to different applications is described, having at least one cover flange (10), having a fastening attachment (9), which divides the cover flange (10) into two legs (12, 13), on the bottom side of the cover flange (10), and having at least one bending groove (14), which is parallel to the profile axis, on the bottom side of at least one of the legs (12, 13), which are preferably of different widths. In order to provide advantageous design conditions, it is proposed that the cover flange (10) carry a coating (11), which forms a film hinge (16), on its outer side opposite to the fastening attachment (9) in the area of the bending groove (14), and the two leg sections on both sides of the bending groove (14) be supported against one another by a hinge block (19).

17 Claims, 6 Drawing Sheets

(56) References Cited

U.S. PATENT DOCUMENTS

| | | | | |
|---|---|---|---|---|
| 7,828,921 | B2 * | 11/2010 | Neuhofer | 52/395 |
| 8,161,708 | B2 * | 4/2012 | Schacht et al. | 52/716.1 |
| 8,245,473 | B2 * | 8/2012 | Schacht | 52/468 |
| 8,245,474 | B2 * | 8/2012 | Schacht | 52/468 |
| 2008/0034696 | A1 | 2/2008 | Neuhofer | |

FOREIGN PATENT DOCUMENTS

| | | |
|---|---|---|
| EP | 1 403 444 | 3/2004 |
| WO | WO 2005/083195 | 9/2005 |
| WO | WO 2006/074824 | 7/2006 |
| WO | WO 2006/110934 | 10/2006 |
| WO | WO 2008/003849 | 1/2008 |

* cited by examiner

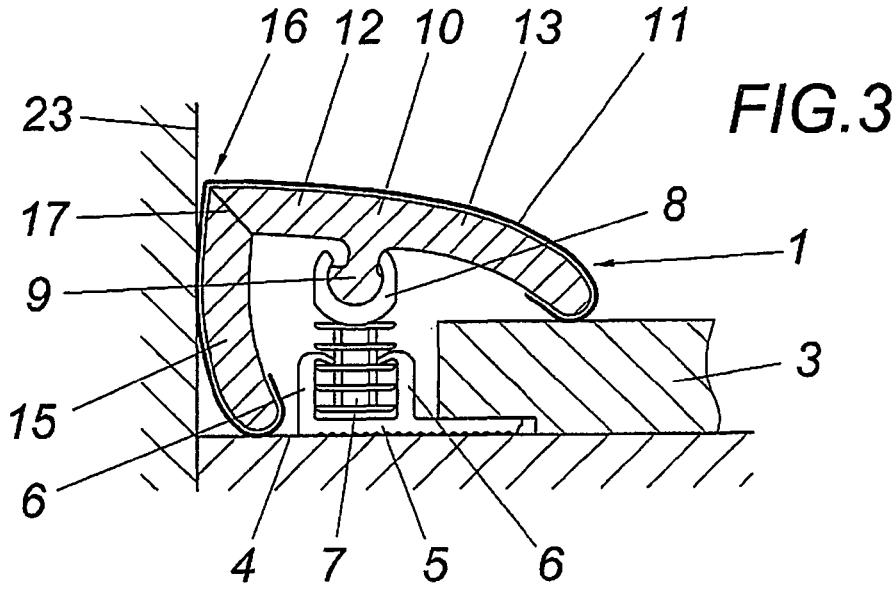
FIG.3
FIG.4
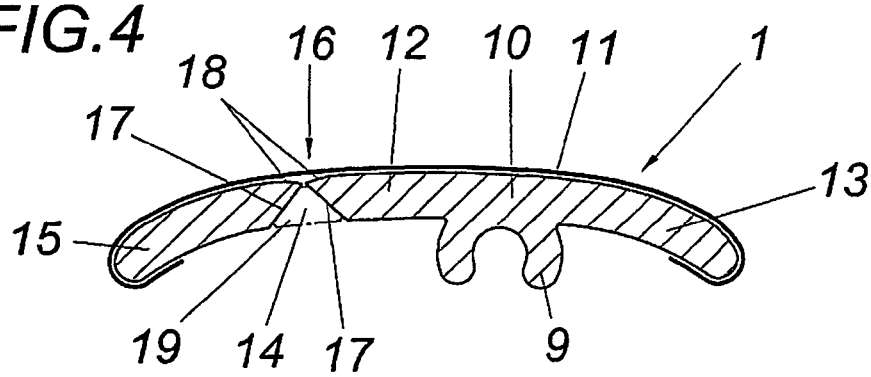
FIG.5
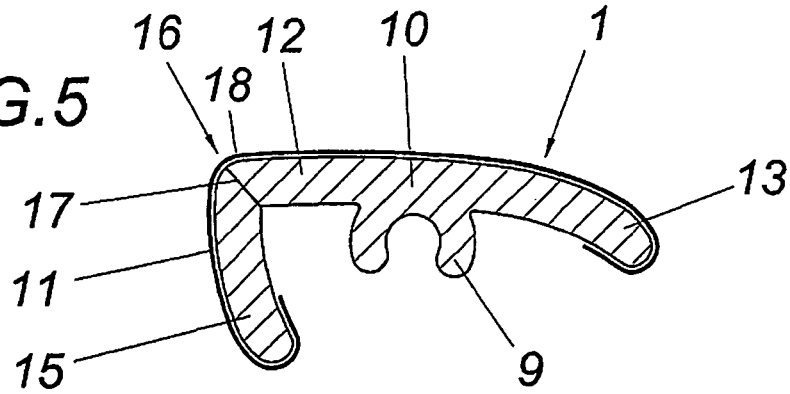

COVER PROFILE FOR FLOORS

CROSS REFERENCE TO RELATED APPLICATIONS

This application is the National Stage of PCT/AT2009/000303 filed on Aug. 6, 2009, which claims priority under 35 U.S.C. §119 of Austrian Application No. A 1301/2008 filed on Aug. 22, 2008, the disclosure of which is incorporated by reference. The international application under PCT article 21(2) was not published in English.

1. FIELD OF THE INVENTION

The invention relates to a cover profile for floors for adaptation to different applications having a cover flange, having at least one fastening attachment, which divides the cover flange into two legs, on the bottom side of the cover flange, and having at least one bending groove, which is parallel to the profile axis, on the bottom side of the at least one of the legs of the cover flange, which are preferably of different widths.

2. DESCRIPTION OF THE PRIOR ART

To be able to use cover profiles for floors in different ways, supplementing a cover profile, which is suitable as a movement profile for covering expansion joints, with the aid of optionally usable auxiliary profiles to form a terminus profile or a transition profile is known (WO 2005/083195 A1), which presumes corresponding auxiliary profiles. In order that a cover profile can be used unchanged as a movement profile between floors of equal height and as a transition profile between floors of different heights, providing the cover flange of the cover profile on its bottom side with a fastening attachment for a pivotably-adjustable mounting in a fastening rail is additionally known (EP 0 711 886 A), which preferably forms a joint axis for the fastening attachment of the cover profile, which is preferably implemented as a joint socket. The fastening attachment divides the cover flange into two legs, preferably of different widths, which may be adapted to different heights of the floor coverings because of the pivot adjustment of the cover profile, in particular if they have prepared bending grooves on their bottom side, in order to buckle the respective outer leg section in relation to the inner leg section according to the height difference of the floor coverings and be able to ensure a pre-tensioned contact of the buckled leg on the adjoining floor covering by excessive bending. However, the weakening of the cover profile by the prepared bending grooves is disadvantageous at least for the case of the non-buckled profile leg and the restriction of the cover profiles to materials which permit such buckling without danger of cracking or breaking.

SUMMARY OF THE INVENTION

The invention is therefore based on the object of designing a cover profile for floors of the type described at the beginning for adaptation to different applications in such a way that no relevant weakening of the cover profiles in the case of non-buckled leg profile must be accepted and the adaptation possibilities are nonetheless improved.

The invention achieves the stated object in that the cover flange carries a coating which forms a film hinge in the area of the bending groove on its outer side opposite to the fastening attachment, and the two leg sections on both sides of the bending groove are supported against one another by a hinge block.

Since, as a result of these measures, the coating and not the material of the cover flange determines the bending behavior of the cover profile, firstly any restriction with respect to the material selection for the cover flange is eliminated. It is solely to be ensured in this context that the material of the coating meets the requirements to be placed on such a film hinge. In order that the buckling conditions allowed by the film hinge, which are advantageous for the adaptation of the cover profile to different applications, do not impair the carrying capacity of the buckled cover profile, the two leg sections of the cover flange, which can each be buckled toward one another, are supported over the bending groove by a hinge block, so that load conditions which are comparable to cover flanges without bending groove result for the cover flange which is secured against buckling via the hinge block.

The hinge block can be implemented in different ways and can comprise an insert which fills up the bending groove at least in longitudinal sections, for example, which prevents mutual buckling of the leg sections separated from one another by the bending groove because of its support on the groove flanks of the bending groove. This insert can be implemented as a profile which engages in a formfitting manner in the bending groove. The mutual support of the two leg sections via a bending groove insert can also be produced by an adhesive bead which at least partially fills up the bending groove, however.

Another mutual support possibility of the leg sections of the cover flange separated from one another by the bending groove results if the film hinge comprises at least one clamp which engages at least in one detent recess in one of the leg sections, which can be implemented either as a corresponding profile rail or as a bow distributed over the length of the bending groove. This clamp, which is fastened on one of the leg sections separated from one another by the bending groove and is removably supported on the other leg section in a detent recess, but can also removably engage in detent recesses of both leg sections, prevents mutual buckling of the leg sections in a support position, without preventing the buckling after the disengagement of the support position. If the clamp is not removed from the cover flange for this purpose, the clamp for the film hinge can have an intended bending line for adaptation to the buckled position of the leg sections of the cover flange which are separated from one another by the bending groove.

Particularly simple structural conditions result in this context if the clamp for the film hinge forms an attachment profile with the fastening attachment for the cover flange, so that the cover flange itself can be implemented without such a fastening attachment. With the fastening of this attachment profile on the bottom side of the cover flange, it is provided with a fastening attachment required for its fastening, which can be adapted to different conditions because of the later installation, without having to change the cover flange itself.

In order that the buckling angle between the leg sections separated from one another by the bending groove can be predefined in the design, the bending groove in the leg of the cover flange can have two groove flanks forming a buckle stop at a wedge angle which corresponds to the buckling angle between the leg sections which can be bent toward one another. Through this measure, mutual support of the leg sections buckled toward one another additionally results, which also provides good load dissipation in the buckled form of the cover profile when the stop-limited abutting leg sections are fixed in this stop position. For this purpose, the two groove flanks which press against one another upon buckling can be glued to one another. However, it is also possible to fix the two leg sections buckled toward one another in the buckled position with the aid of at least one clamp which at least engages in one detent recess in one of the leg sections, the clamp again being able to comprise a rail-type profile or bows. It is only decisive that the leg sections abutting one another along the groove flanks of the bending groove are also prevented from pivoting apart under a load.

Since the clamps used for the hinge block frequently cannot also be readily used for the fixing of the buckled position of the cover profile, but an additional clamp part increases the expenditure, the clamp for fixing the buckled position can form a part of the barrier hinge which is connected via an intended breakpoint to the remaining section of the clamp for this barrier hinge, so that for the use of the buckled cover profile, the clamp part required for fixing the buckled position only has to be separated from the hinge block along the intended breakpoint.

If the clamp provided for the hinge block is bent over along a corresponding intended bending line to buckle the cover profile, this bent-over clamp can also be used for fixing the buckled position of the cover profile if this angled clamp engages in a corresponding detent recess for fixing the buckled position. This is true in particular for the implementation of the hinge block in the form of an attachment profile fastenable on the cover flange.

The film hinge formed by the coating of the cover flange in the area of the bending groove not only allows buckling of the leg sections separated from one another by the bending groove on the side of the bending groove, but rather also buckling in the opposite direction, which increases the design freedom for the cover profile and allows the implementation of special baseboards, in which the narrower leg of the cover flange presses against the wall protruding from the floor and the outwardly placed edge section of the wider leg is supported on the floor. In order that the outwardly placed edge section of the cover flange can be secured in its position, which is not fixable via the bending groove, the edge-side leg section with respect to the bending groove can be supported by a web of a mount for the cover profile in a spread-open position upon use of the cover profile as a baseboard, it fundamentally not being important whether this mount is associated with the floor or the wall, although the mount is preferably to be provided in the wall area because of the space conditions.

If the coating of the cover flange forming the film hinge is cut through, preferably from the outer side of the cover flange, the cover profile resolves into two parts which are each usable per se, and which may be used in the transition area from the floor to the wall as quarter rounds. For the wider part of the cover profile, fastening via the fastening attachment on the bottom side of the divided cover profile can even be provided.

The pivot location of the cover profile adapted to the respective application can be easily achieved by a corresponding pivot displacement via the fastening attachment on the bottom side of the cover flange. Favorable design conditions result if the cover flange can be placed on laterally-ribbed dowel pins with the aid of the fastening attachment, whose heads forming joint sockets or joint axes cooperate with the fastening attachment, which is implemented as a joint axis or joint socket. The laterally-ribbed dowel pins can be hammered in a typical way into corresponding holes, without being restricted to such holes for receiving the dowel pins, because the dowel pins can also be used in typical fastening rails, in particular if the dowel pins have flattened areas on diametrically opposing sides and can be inserted using these flattened areas into a U-shaped fastening rail, optionally after being shortened. The flattened area ensures a twist-locked hold for dowel pins in the fastening rail.

It does not need to be particularly emphasized that the fastening attachments on the bottom side of the cover flange can be implemented very differently, because the implementation of the fastening attachment is not important, but rather the possibility of adapting the cover profile by optional buckling to different usage conditions. For this reason, the fastening attachments can also comprise adhesive beads on the bottom side of the cover flange, so that the cover profile only has to be glued with the aid of these adhesive beads onto a mount, which can also be formed by the adjoining structure parts, such as wall and/or floor sections.

BRIEF DESCRIPTION OF THE DRAWING

The object of the invention is shown as an example in the drawing. In the figures:

FIG. 3 shows the buckled cover profile as a terminus profile, FIG. 4 shows an embodiment variant of a cover profile in a simplified cross-section, FIG. 5 shows the cover profile according to FIG. 4 in a buckled position.

DESCRIPTION OF THE PREFERRED EMBODIMENTS

Figure 1:
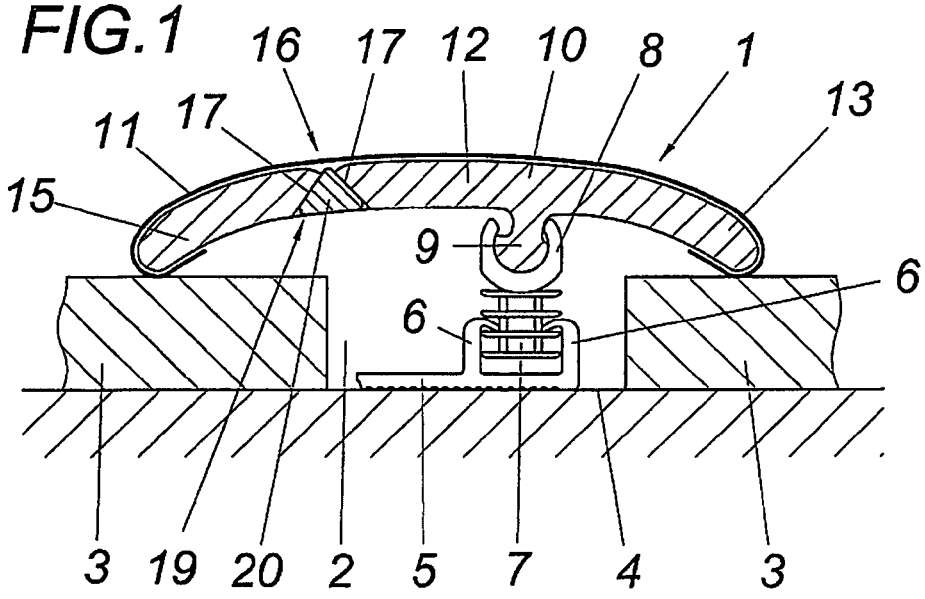
FIG. 1 shows a cover profile used as a movement profile in a simplified cross-section.

As can be inferred from FIG. 1, a joint 2 between two floor sections 3 at the same level is bridged by the cover profile 1. The cover profile 1, which is thus used as a movement profile, is fixed in the joint 2 with the aid of a fastening rail 5, which is screwed onto a substrate 4 receiving the floor sections 3, for example, which forms two legs 6 protruding in the form of a U-profile to receive laterally-ribbed dowel pins 7. These dowel pins 7 are flattened on diametrically opposing sides for better support between the legs 6 within the fastening rail 5. The heads of the dowel pins 7 form a joint socket 8 for the pivotably-adjustable accommodation of a fastening attachment 9 on the bottom side of the cover flange 10 of the cover profile 1, which is therefore solely to be engaged via the fastening attachment 9 in the joint socket 8 of the dowel pins 7 like a snap closure in order to be inserted using the dowel pins 7 in the fastening rail 5. The dowel pins 7 can be shortened appropriately for adaptation to the height of the floor sections 3.

The cover profile 1 is provided on the outer side of the cover flange 10 with a coating 11, which is capable of implementing a film hinge, as will be explained in greater detail hereafter.

Figure 2:
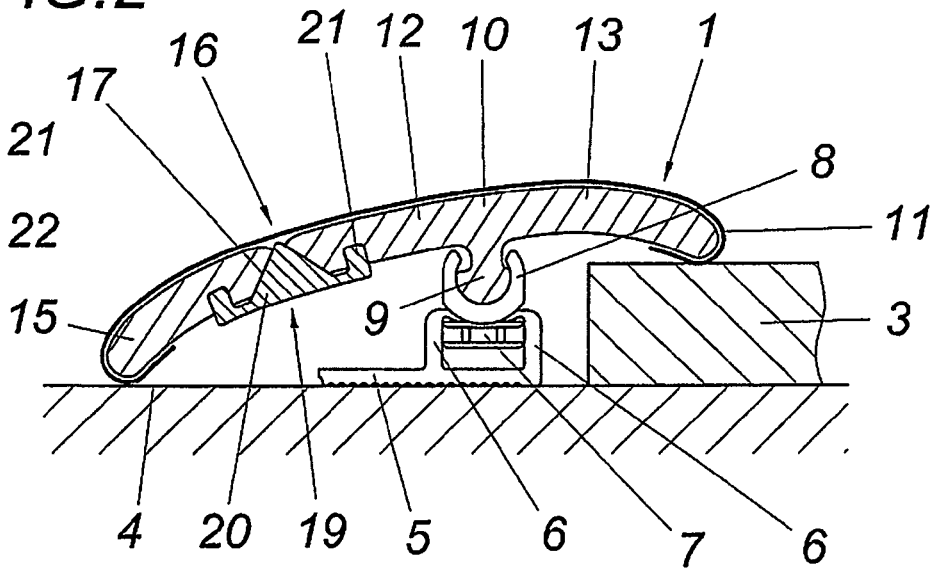
FIG. 2 shows the cover profile as a transition profile in a view corresponding to FIG. 1.

FIG. 2 shows the use of the cover profile 1 as a transition profile, which bridges a step of the height caused by the floor section 3, in that it is pivoted within the joint socket 8 of the dowel pin 7 in such a way that the two legs 12, 13 of the cover flange 10 separated from one another by the fastening attachment 9 are supported on one side on the substrate 4 and on the other side on the floor section 3. In order to allow the support, the dowel pins 7 must be shortened in comparison to FIG. 1.

For further adaptation of the cover profile 1 to different applications, at least one of the two legs 12, 13 of the cover flange 10 is buckled. For this purpose, according to FIG. 4, a bending groove 14 is cut into the cover profile 1 on the bottom side, preferably of the wider leg 12, up to the coating 11, so that the edge-side section 15 of the leg 12 can be pivoted in relation to the inner leg section around the coating 11 forming the film hinge 16. Although the cross-sectional shape of the bending groove 14 can result differently, particularly advantageous embodiments result if the bending groove 14 forms two groove flanks 17 forming a bending stop, which are cut at a wedge angle which corresponds to the buckling angle between the two leg sections which can be buckled toward one another, so that after the bending over, the leg sections press against one another via the groove flanks 17, as may be seen in the buckled position shown in FIG. 5. These groove flanks 17 forming a buckle stop result in a simple way using bending grooves 14 which are triangular in cross-section, but this is not required. So as not to have to accept sharp-edged buckling of the coating 11 in the area of the film hinge 16, which is impermissible for the coating 11, the cover flange 10 can be provided with rounded sections 18, which are covered by the coating 11 and each drop off in relation to the bending groove 14, in the area of the film hinge 16 on the outer side facing toward the coating 11, so that upon buckling of the edge-side leg section 15 beyond the leg sections, these rounded sections 18 combine to form a rounded area, against which the coating 11 rests without bending.

The cover profile 1 according to FIGS. 4 and 5 additionally shows that the fastening attachment 9 on the bottom side of the cover flange 10 does not have to have the form of a joint axis, but rather can also be implemented as a joint socket, which is accompanied by a corresponding adaptation of the mount in the form of a joint axis, for example.

The bending groove 14 which divides the leg 12 of the cover flange 10 into two sections significantly weakens the cover profile 1 in the non-buckled position, however. In order to ensure a sufficient carrying capacity for the cover profile 1 in the non-buckled usage position, the two leg sections on both sides of the bending groove 14 are supported against one another by a hinge block 19, which is indicated by dot-dash line in FIG. 4. This hinge block 19 is formed according to the exemplary embodiment of FIG. 1 by an insert 20, which fills up the bending groove 14, in the form of a profile adapted to the groove cross-section, which is glued to the groove flanks 17. Such gluing is not required in the embodiment according to FIG. 2, because the profile of the insert 20 has additional detent lugs 21, which engage in corresponding detent recesses 22 of the leg sections on both sides of the bending groove 14.

In FIG. 3, the cover profile 1 is shown having the buckled edge-side leg section 15 as a terminus profile for a floor section 3 in the area of an adjoining wall 23. The buckled leg section 15 is supported on the substrate 4 for the floor section 3, while the leg 13 of the cover flange 10 rests on the floor section 3. The height of the floor section 3 and the pivot location of the leg 13 dependent thereon can be taken into consideration by the length of the laterally-ribbed dowel pins 7 engaging in the fastening rail 5.

Figure 6:
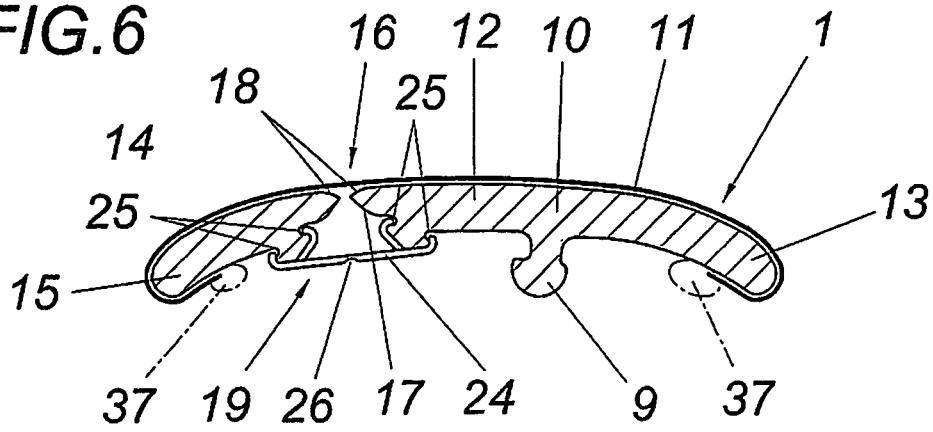
FIG. 6 shows a further embodiment of a cover profile according to the invention in cross-section.
Figure 7:
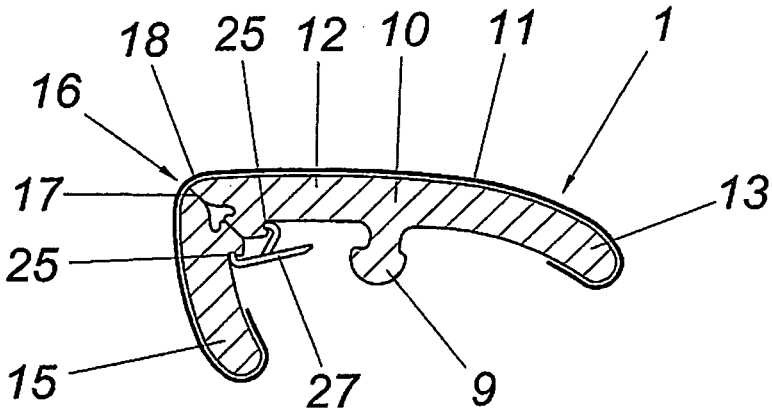
FIG. 7 shows the cover profile according to FIG. 6 in the buckled state.

In FIG. 6, the unbuckled stretched location of the cover profile 1 is secured by a hinge block 19 in the form of a clamp 24, which engages in detent recesses 25 of the mutually supporting leg sections. This clamp 24, which is implemented symmetrically to the longitudinal axis of the bending groove 14 in the exemplary embodiment according to FIG. 6, and which can be provided in the form of a rail, or also in the form of bows distributed over the groove length, can be separated along an intended breakpoint 26 into two parts which each form a clamp 27, in order to fix the buckled position of the cover profile 1 predefined by the abutting groove flanks 17 with the aid of these clamps 27 formed from the parts, as can be inferred from FIG. 7.

Figure 8:
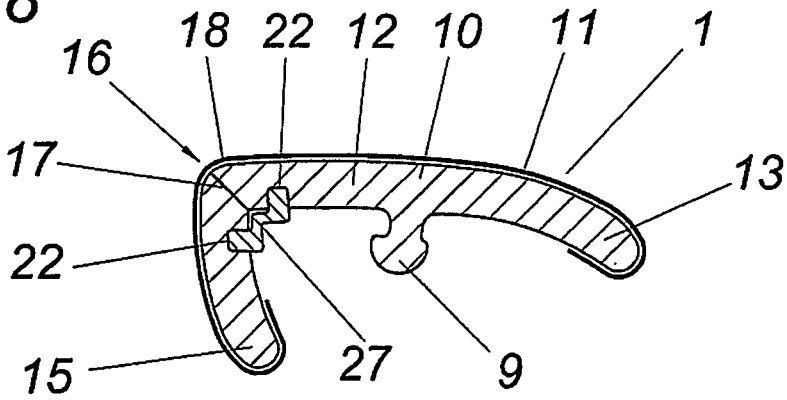
FIG. 8 shows a view corresponding to FIG. 7 of a cover profile having a rail-type clamp which fixes the buckled position.

FIG. 8 shows a further implementation of a clamp 27 for fixing the buckled position of the cover profile 1, which corresponds to that used in FIG. 2, so that the detent recesses 22 can be used for inserting the clamps 27.

Figure 9:
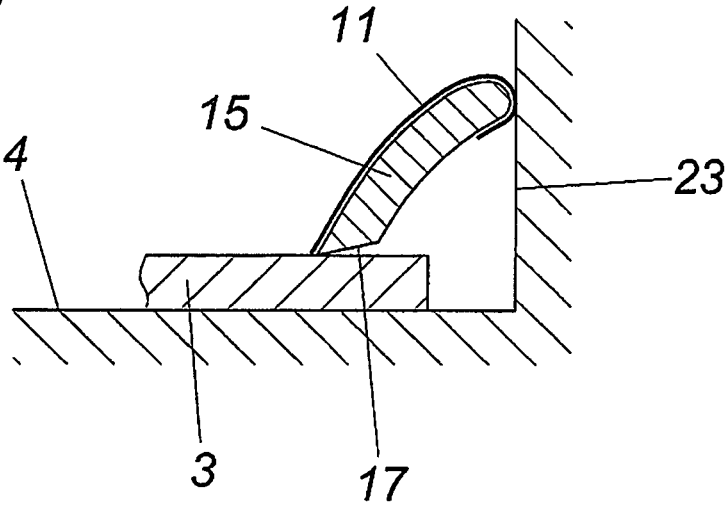
FIG. 9 shows a part of the cover profile used as a quarter round.
Figure 10:
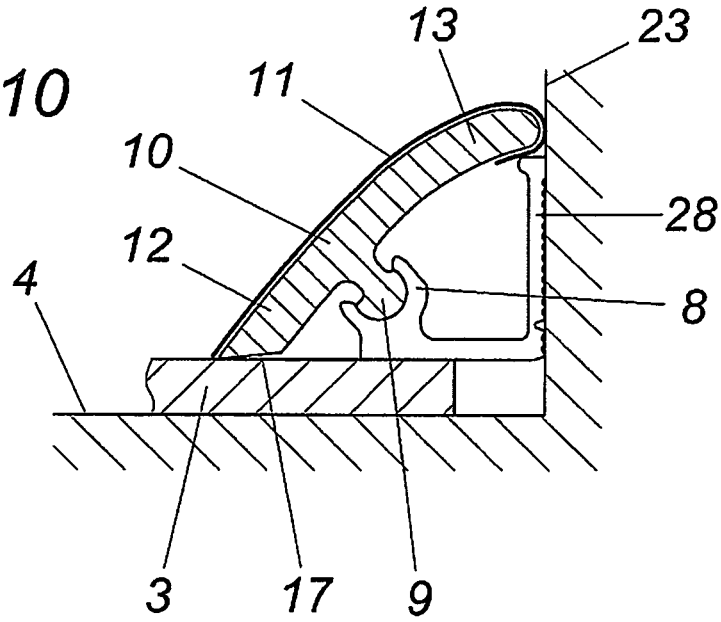
FIG. 10 shows the divided cover profile as a quarter round in a further embodiment.

For further reshaping of the cover profile 1, the film hinge 16 can be cut through, whereby the cover profile is resolved into two partial profiles. The edge-side leg section 15 can be inserted as a small quarter round between a floor section 3 and a wall 23 in a typical manner and can be fastened by gluing, screwing, or nailing in a normal manner, as shown in FIG. 9. The remaining cover flange 10 having the fastening attachment 9 can be used as a middle quarter round, as shown in FIG. 10. The fastening attachment 9 can be used for fastening the quarter round, for example, using mounts 28, as shown in FIG. 10.

Figure 11:
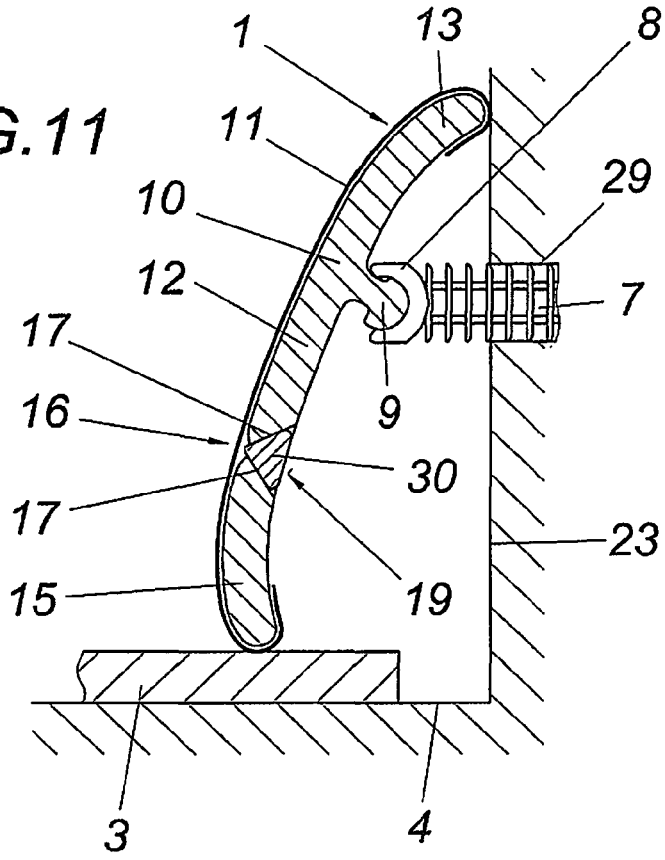
FIG. 11 shows the cover profile as a baseboard.

FIG. 11 shows the use of the undivided cover profile 1 as a baseboard, the legs 12 and 13 being supported on one side on the floor section 3 and on the other side on the adjoining wall 23. FIG. 11 additionally shows that a fastening rail 5 is not required for mounting the cover profile 1. The dowel pins 7 can also be hammered directly into corresponding holes 29 in the wall 23. In addition, this exemplary embodiment shows that an adhesive bead 30, which at least partially fills up the bending groove between the groove flanks 17, can also be used as the hinge block 19.

Figure 12:
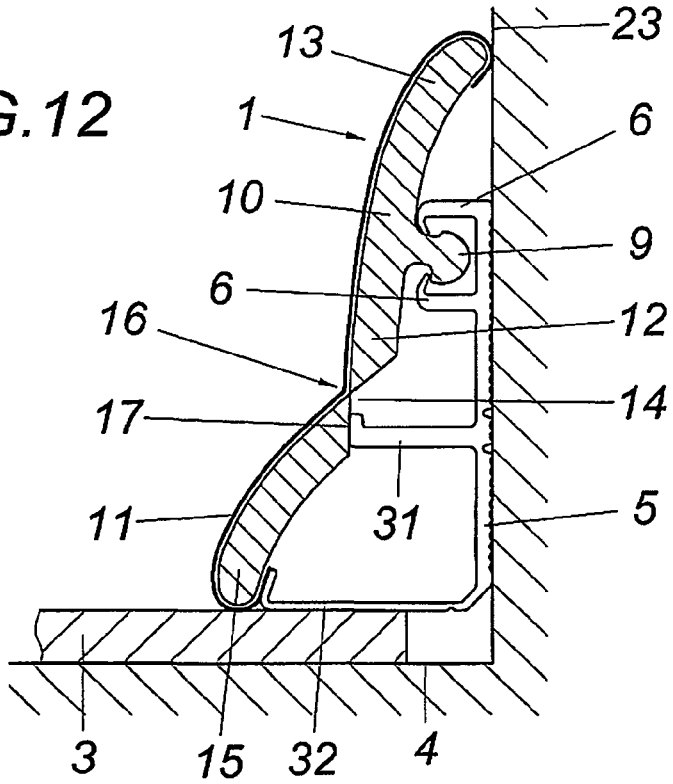
FIG. 12 shows the outwardly buckled cover profile as a baseboard.

The edge-side leg section 15 of the cover flange 10, which is divided by the bending groove 14 from the remaining leg 12, can be pivoted outward in the opposite direction according to FIG. 12, in order to obtain a particularly pronounced baseboard with the aid of the cover profile 1, for example. If the spatial conditions permit it, as in this case, the fastening attachment 9 on the bottom side of the cover flange 10 can also be inserted directly into the fastening rail 5. The outwardly placed leg section 15 does not find a hold in the area of the groove flanks 17, in contrast to its pivoted-in stop position. In order to nonetheless achieve a stable stop location for the leg section 15, the fastening rail 5 can have at least one web 31 for supporting the spread-open leg section 15. In the present case, the web 31 presses against the groove flank 17 of the leg section 15. In addition, a further support leg 32 is provided for the free edge of this leg section 15. Although simple installation conditions are achieved using a fastening rail 5 which forms at least one support web 31, 32 for the spread-open leg section 15, the support of the leg section 15 in relation to the remaining leg 12 of the cover flange 10 could also be achieved by a support clamp, which engages in corresponding detent recesses on both sides of the bending groove 14.

Figure 13:
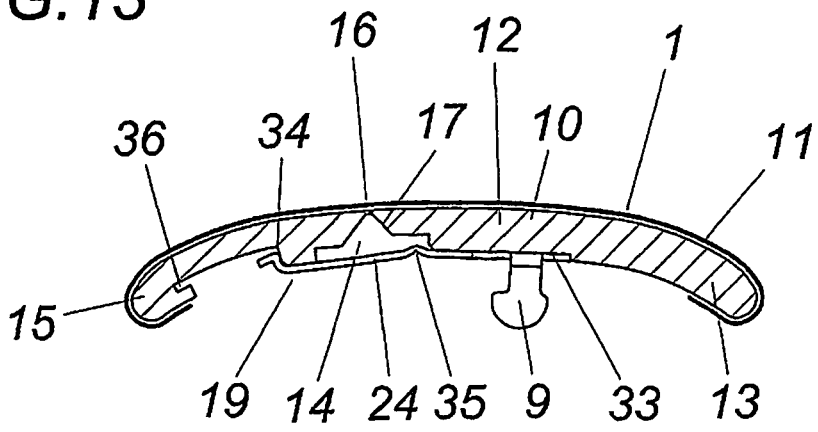
FIG. 13 shows a further embodiment variant of a cover profile in cross-section.
Figure 14:
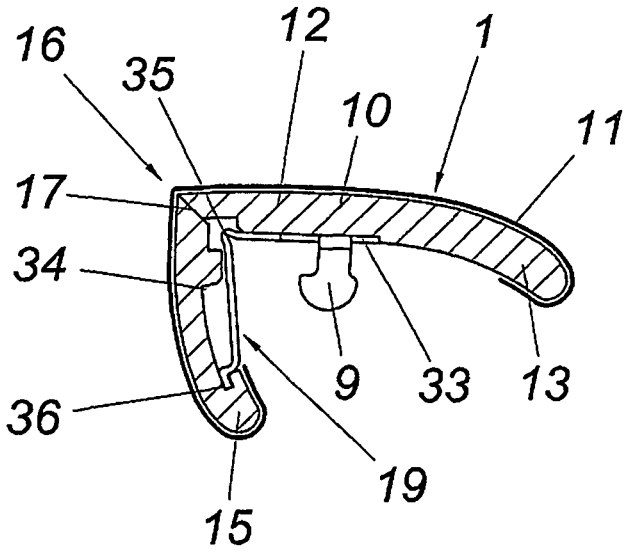
FIG. 14 shows the cover profile from FIG. 13 in the buckled position.

The cover profile 1 according to FIG. 13 differs from the other cover profiles 1 above all in that the fastening attachment 9 is first fastened later to the bottom side of the cover flange 10 as a part separate from the cover flange 10, preferably by screws or gluing. This fastening attachment 9 is part of an attachment profile 33, which forms the fastening attachment 9 by tongue-like bent-out parts. This attachment profile 33 additionally forms the hinge block 19, in the form of a clamp 24, which only engages in a detent recess 34 in the edge-side leg section 15, because it is permanently connected to the other section of the leg 12. In order that this cover profile 1 according to FIG. 14 can be buckled, the attachment profile or the clamp 24 is provided with an intended bending line 35. After the bending over of the attachment profile 33 along the intended bending line 35, the clamp 24 can also be used as a clamp for fixing the buckled position, when a detent recess 36 for the bent-over web of the clamp 24 is provided in the leg section 15.

Of course, the invention is not restricted to the illustrated exemplary embodiments, since it is concerned above all with reinforcing the cover flange 10 in the area of the bending groove 14 through a hinge block, in order to be able to absorb the occurring loads in spite of the weakening by the bending groove 14. This is true in particular for the implementation of the fastening attachment, whose function is also achieved by at least one adhesive bead 37 on the bottom side of the cover flange 10. In FIG. 6, such adhesive beads 37 are indicated by dot-dash lines, with the aid of which the cover profile 1 can be glued onto two floor sections, for example, without having to provide a fastening rail 5.

The invention claimed is:

1. A cover profile for floors having a cover flange, having at least one fastening attachment, which divides the cover flange into two legs, on the bottom side of the cover flange, and having at least one bending groove parallel to a profile axis on the bottom side of at least one of the legs of the cover flange, wherein the cover flange carries a coating, which forms a film hinge, on an outer side of the cover flange opposite to the fastening attachment in the area of the bending groove, and the two leg sections on both sides of the bending groove are supported against one another by a releasable hinge block.

2. The cover profile according to claim 1, wherein the hinge block is implemented as an insert which fills up the bending groove at least in longitudinal sections.

3. The cover profile according to claim 2, wherein the insert has a profile which engages in a formfitting manner in the bending groove.

4. The cover profile according to claim 2, wherein the insert comprises an adhesive bead.

5. The cover profile according to claim 1, wherein the hinge block comprises at least one clamp, which engages at least in a detent recess in one of the leg sections.

6. The cover profile according to claim 5, wherein the clamp has an intended bending line for adaptation to the buckled position of the leg sections of the cover flange separated from one another by the bending groove.

7. The cover profile according to claim 6, wherein the clamp fastened on the leg section having the fastening attachment forms an attachment profile with the fastening attachment for the cover flange.

8. The cover profile according to claim 5, wherein the clamp for fixing the buckled position forms a part of the hinge block connected via an intended breakpoint to the remaining section of the clamp for this hinge block.

9. The cover profile according to claim 7, wherein the attachment profile bent over along the intended bending line, in the buckled position of the leg sections, forms a clamp which engages in a detent recess of the edge-side leg section in relation to the cover flange for fixing the buckled leg section.

10. The cover profile according to claim 1, wherein the bending groove in the leg of the cover flange has two groove flanks which form a bending stop at a wedge angle, which corresponds to the buckling angle between the two leg sections which are buckled toward one another.

11. The cover profile according to claim 10, wherein the groove flanks which abut one another upon buckling of the leg sections are connectable to one another by an adhesive seam.

12. The cover profile according to claim 10, wherein the two leg sections buckled toward one another are fixable in the buckled position with the aid of at least one clamp which engages at least in one detent recess in one of the leg sections.

13. The cover profile according to claim 1, wherein the edge-side leg section in relation to the bending groove, upon use of the cover profile as a baseboard, is supported by at least one web of a mount for the cover profile in a spread-open position.

14. The cover profile according to claim 1, wherein the coating of the cover flange forming the film hinge can be cut through.

15. The cover profile according to claim 1, wherein the cover flange is placed with the aid of the fastening attachment on laterally-ribbed dowel pins, whose heads, which form joint sockets or joint axes, cooperate with the fastening attachment implemented as a joint axis or joint socket.

16. The cover profile according to claim 15, wherein the dowel pins have flattened areas on diametrically opposing sides and are insertable into a U-shaped fastening rail using these flattened areas.

17. The cover profile according to claim 1, wherein the cover profile is glued on a mount with the aid of at least one adhesive bead, which forms the fastening attachment on the bottom side of the cover flange.

* * * * *